US010213640B2

(12) United States Patent
St. Jeor

(10) Patent No.: US 10,213,640 B2
(45) Date of Patent: Feb. 26, 2019

(54) ANATOMICAL YOGA HAND GRIP AND TRAINER FOR RELIEVING WRIST STRAIN

(71) Applicant: Chris St. Jeor, Salt Lake City, UT (US)

(72) Inventor: Chris St. Jeor, Salt Lake City, UT (US)

(73) Assignee: Chris St. Jeor, Salt Lake City, UT (US)

( * ) Notice: Subject to any disclaimer, the term of this patent is extended or adjusted under 35 U.S.C. 154(b) by 0 days.

(21) Appl. No.: 15/637,796

(22) Filed: Jun. 29, 2017

(65) Prior Publication Data

US 2019/0001182 A1 Jan. 3, 2019

Related U.S. Application Data

(60) Provisional application No. 62/447,372, filed on Jan. 17, 2017.

(51) Int. Cl.
*A63B 21/00* (2006.01)
*A63B 23/12* (2006.01)

(52) U.S. Cl.
CPC ..... *A63B 21/4035* (2015.10); *A63B 21/4039* (2015.10); *A63B 23/12* (2013.01)

(58) Field of Classification Search
CPC . A63B 21/4035; A63B 21/4039; A63B 23/12; A63B 23/03525; A63B 21/068; A63B 23/1209; A63B 23/03541; A63B 23/03508
See application file for complete search history.

(56) References Cited

U.S. PATENT DOCUMENTS 5,181,897 A * 1/1993 Agan ..... A63B 23/12 482/141
5,226,868 A * 7/1993 Montgomery ..... A63B 21/4035 482/141
7,156,791 B2 * 1/2007 Edwards ..... A63B 21/0004 446/120
7,377,888 B2 * 5/2008 Godbold ..... A63B 26/003 482/141
7,468,025 B2 * 12/2008 Hauser ..... A63B 21/00047 482/141
7,585,262 B1 * 9/2009 Vayntraub ..... A63B 23/12 482/141
7,824,319 B2 * 11/2010 Carlesimo ..... A63B 21/00047 446/85
9,155,934 B2 * 10/2015 Kassel ..... A63B 21/0414
9,308,416 B1 * 4/2016 Oliverlo ..... A63B 23/0355
2003/0199375 A1 * 10/2003 Edwards ..... A63B 21/0004 482/148
2005/0101461 A1 * 5/2005 Johnson ..... A63B 21/0004 482/141
2006/0014615 A1 * 1/2006 Godbold ..... A63B 21/00047 482/141
2010/0144502 A1 * 6/2010 Hinds ..... A63B 21/16 482/139

(Continued)

*Primary Examiner* — Andrew S Lo
(74) *Attorney, Agent, or Firm* — Workman Nydegger

(57) ABSTRACT

An ergonomic yoga device for evenly distributing the weight of a user across a handgrip contoured to relieve stress on the palm and wrist of a yogi comprising: two V-shaped legs interconnected with a bar declined toward a distal end, and a handgrip defining an annual recess and a laterally-cantilevered bulbous rest.

20 Claims, 6 Drawing Sheets

(56) References Cited

U.S. PATENT DOCUMENTS

| | | | | |
|---|---|---|---|---|
| 2010/0261590 | A1* | 10/2010 | Fares | A63B 21/00047 482/131 |
| 2012/0040811 | A1* | 2/2012 | DeTore | A63B 21/00047 482/141 |
| 2012/0083396 | A1* | 4/2012 | Aquino | A63B 21/0004 482/131 |
| 2012/0316043 | A1* | 12/2012 | Mangalindan | A63B 23/1236 482/141 |
| 2013/0072365 | A1* | 3/2013 | Ross | A63B 21/1469 482/141 |
| 2013/0274078 | A1* | 10/2013 | Andrews | A63B 23/1227 482/141 |
| 2013/0316886 | A1* | 11/2013 | Lynch | A63B 26/003 482/146 |
| 2014/0066274 | A1* | 3/2014 | Kassel | A63B 21/0414 482/141 |
| 2014/0357459 | A1* | 12/2014 | Izzo | A63B 23/1236 482/141 |
| 2015/0126340 | A1* | 5/2015 | White | A63B 21/072 482/93 |
| 2015/0335935 | A1* | 11/2015 | Peralo | A63B 21/4035 482/93 |
| 2016/0067546 | A1* | 3/2016 | Hunter, Jr. | A63B 23/1236 482/141 |

* cited by examiner

ANATOMICAL YOGA HAND GRIP AND TRAINER FOR RELIEVING WRIST STRAIN

BACKGROUND

Field of the Invention

This invention relates to yoga trainers, and more particularly relates to an ergonomic yoga device for evenly distributing the weight of a user across a handgrip contoured to relieve stress on the wrist of a yogi.

Description of the Related Art

Yoga training requires a multitude of athletic skills, including balance, strength, flexibility, and controlled graceful movements. Yogi (those performing yoga) must perform various actions while entering into or striking a pose or asana. Some exercises require pressing a hand on a mat or ground surface. Many poses and exercises in yoga require yogi to distribute their body weight across their wrists when performing these maneuvers and to potentially overstress tendons and ligament fibers within the wrists. The yogi must be able to perform these maneuvers without damages the wrists or hands, and efficient hardware equipment for preventing injury is unknown in the art.

Commonly a trainer or spotter assists a training yogi while the yogi is learning exercise or poses as the yogi is likely to lose balance at this time. It is difficult for beginners and masters of yoga to develop the strength and flexibility through the writs necessary to perform the maneuvers without damaging tendons, bone and soft tissue, all of which are strained by use of a flat palm on a ground surface.

A variety of apparati have been developed over the years in the prior art for helping distribute pressure across the palm surface, but none which optimally alleviate torque of writs. The most prominent of which is a flexible floor mat. Other apparati include a single bar, parallel bars, a balance beam, or still rings, all of which have very limited utility in yoga. Although these trainers improve efficiency and relieve some strain on tendons, they do not fully or optimally relieve pressure on both the wrist and the palm and are not ergonomically or anatomically shaped. A further disadvantage of these devices is that they are often cumbersome and are not easily portable. Commercially parallel bars are available, but students of yoga have no suitable, portable device for use in training.

Although certain apparati in the prior art disclose handgrips which have some measure of anatomical or ergonomic design, none of the prior art grips are truly ergonomically designed to minimize or eliminate hand and wrist fatigue and damage for the purposes of yoga.

All of the devices taught in the prior art have shortcomings. Therefore, a need exists for a device that can support a yogi's hands in keeping their balance and reducing wrist strain all while learning a wide variety of maneuvers/exercises/poses/asana.

SUMMARY

From the foregoing discussion, it should be apparent that a need exists for an anatomical yoga handgrip and trainer for uniform distribution of weight. Beneficially, such a device would overcome inefficiencies with the prior art by providing a handgrip with anatomical or ergonomic contouring adapted to relieve wrist strain.

The present invention has been developed in response to the present state of the art, and in particular, in response to the problems and needs in the art that have not yet been fully solved by currently available apparti. Accordingly, the present invention has been developed to provide a yoga training device for relieving wrist strain, the yoga training device comprising: a distal v-shaped leg for engaging a ground surface, the distal v-shaped leg having a first height from the ground surface, the distal v-shaped leg affixed to an axial bar; a proximal v-shaped leg for engaging a ground surface, the proximal v-shaped leg having a second height from the ground surface, the proximal v-shaped leg affixed to the axial bar; and an ergonomic polymeric handgrip having a distal end, a proximal end, a helical portion and a narrow, annular distal neck recessed to support the index finger and thumb of a user, wherein the helical portion supports the palm of a user.

The distal v-shaped leg and the proximal v-shaped leg may be affixed to terminal ends of the bar. The distal v-shaped leg, the proximal v-shaped leg and the bar may all be formed as a single integrated piece.

The distal v-shaped leg, the proximal v-shaped leg, the bar, and the handgrip may all be formed as a single integrated piece. The single integrated piece may comprise one of metal alloy and polymeric materials.

The bar may be cylindrical in some embodiments. The bar may be oblong through a cross section. The first height of the distal leg may exceed the second height of the proximal leg by more than 10% such that the bar is declined toward the proximal leg.

The helical portion may cantilever laterally from the proximal half of the handgrip forming a laterally overhanging wing. In other embodiments, the distal neck positions on the distal end of the handgrip.

The bar may be arcuate. The distal leg and proximal leg may be convex through an upwardly-rising plane.

A second yoga training device for relieving wrist strain is provided, the yoga training device comprising: a distal v-shaped leg for engaging a ground surface, the distal v-shaped leg having a first height from the ground surface, the distal v-shaped leg affixed to an axial bar; a proximal v-shaped leg for engaging a ground surface, the proximal v-shaped leg having a second height from the ground surface, the proximal v-shaped leg affixed to the axial bar; wherein the first height of the distal leg exceeds the second height of the proximal leg by 10-70% such that the bar is declined toward the proximal leg; an ergonomic polymeric handgrip having a distal end, a proximal end, a cantilevered wing and a narrow, annular proximal neck recessed to support the index finger and thumb of a user, wherein the cantilevered wing supports the palm of a user.

A third yoga training device for relieving torque on wrist is provided, the yoga training device comprising: a distal v-shaped leg for engaging a ground surface, the distal v-shaped leg having a first height from the ground surface, the distal v-shaped leg affixed to an axial bar; a proximal v-shaped leg for engaging a ground surface, the proximal v-shaped leg having a second height from the ground surface, the proximal v-shaped leg affixed to the axial bar; wherein the first height of the distal leg exceeds the second height of the proximal leg by 10-70% such that the bar is declined toward the proximal leg; an ergonomic polymeric handgrip having a distal end, a proximal end, a bulbous portion and a narrow proximal neck recessed to support the index finger and thumb of a user, wherein the bulbous portion supports the palm of a user; wherein the bulbous portion cantilevers laterally from the proximal half of the handgrip; wherein the distal neck positions on the distal end of the handgrip.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It is an object of the present invention to provide a safe, simple yoga handgrip trainer. The utility and novelty of this handgrip lies in its semi-helical laterally-cantilevered ergonomic and anatomic handgrip supported by two lower support bars or legs or support rods fixed to distal and proximal ends of the handgrip supporting both sides of the handgrip and nonparallelism with a ground surface. Yogi use this trainer 100 to practice inverted body positions above the device 100. The ergonomic contouring of the of the handgrip relieves stress on the wrist of user and allows a user to shift the angle of their arm relative to ground surface to reduce stress and tension on the tendons of the lower wrist.

Figure 1:
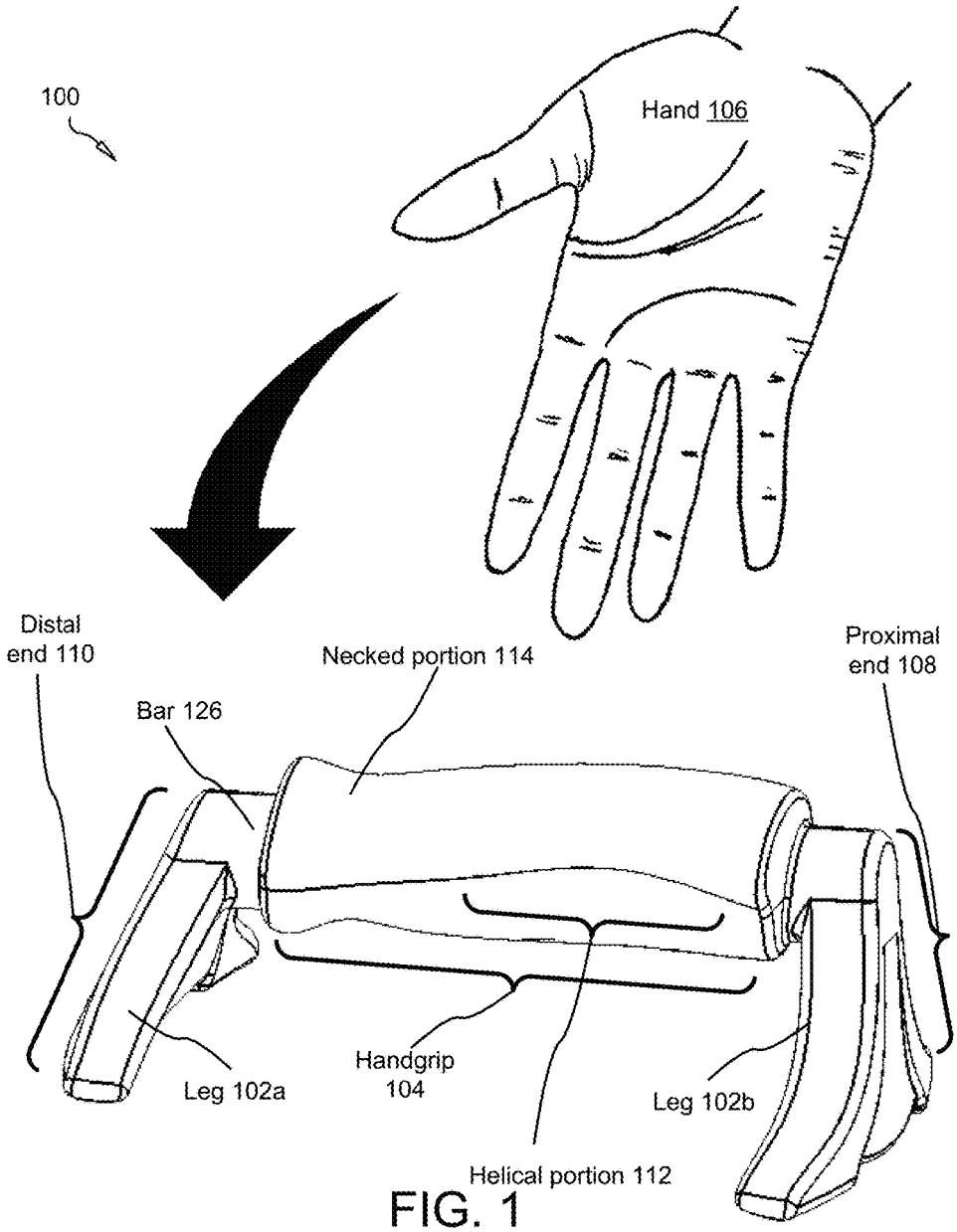
FIG. 1 is an environmental side perspective view of an anatomical yoga handgrip and trainer for uniform distribution of weight in accordance with the present invention.

FIG. 1 is a side perspective view of an anatomical yoga handgrip and trainer 100 for uniform distribution of weight in accordance with the present invention.

The handgrip 104 is sized to provide a sufficient area for a training yogi to enter into a handstand, practice various yoga maneuvers, and roll out of the those maneuvers onto a ground surface.

In preferred embodiment, the handgrip 104 is between two inches and twelve inches in length. However, the handgrip 104 may dimensioned in any size to allow the yogi to practice without hindrance.

The bar 126 interconnects the legs 102*a-b*. While the bar 126 as shown is cylindrical, the bar form other shapes through a cross section to prevent the handgrip 104 from rotating axially about the bar 126. The bar 126 may formed from any rigid material including metals, metal alloys, or polymeric materials and may be formed as a single integrated piece with the legs 102*a-b* and/or the handgrip 104. The bar 126 may be tubular, solid, irregularly shaped, including U-shaped, V-shaped, H-shaped or I-shaped through a cross section.

The legs 102*a-b* are V-shaped as shown, forming a central recess between each side of the leg 102 which may be filled with polymeric materials in some embodiments as shown. The legs 102*a-b* engage a ground surface and are affixed at their tapered upper section to the bar 126.

The leg 102*a* may be slightly convex (outwardly protruding) and the leg 102*b* may likewise be convex. In alternative embodiments, the legs 102*a-b* are concave. The tips of the legs 102 which engage the ground surface turn back in toward the handgrip 104 in some embodiments.

The leg 102*a* is shorter in some embodiments than the leg 102*b* to relieve wrist stress to a user by orienting the bar 126 in declination toward the distal end 110 of the device 100 relative to a ground surface. In various embodiments, the height of the proximal end 108 of the device 100 exceeds the height of the distal end 110 by 10 to 100%, or by 0.5 to 5 inches. In one embodiment, the height of the proximal end 108 of the device 100 exceeds the height of the distal end 110 by 10 to 70%.

When using the trainer on a ground surface, pressure imparted to the wrists is shifted by the declination of the bar 126.

The bar 126 interconnects the legs 102*a-b*. While the bar 126 as shown is cylindrical, the bar form other shapes through a cross section to prevent the handgrip 104 from rotating axially about the bar 126. The bar 126 may formed from any rigid material including metals, metal alloys, or polymeric materials and may be formed as a single integrated piece with the legs 102*a-b* and/or the handgrip 104. The bar 126 may be tubular, solid, irregularly shaped, including U-shaped, V-shaped, H-shaped or I-shaped through a cross section.

The handgrip 104 inserts over and/or envelopes the bar 126. The various embodiments, the handgrip 104 is heat-pressed around the bar 126. The handgrip 104 may be formed from metal alloys or organic materials (e.g., wood or leather) but is preferably formed from polymeric materials and may be fabricated as a single integrated piece with the legs 102*a-b* and the bar 126.

The handgrip 104 defines an annular recess circumscribing, or partially-circumscribing, a half of the handgrip 104 located on the distal end 110 of the device 100. This recess, or necked portion 114, is sized for receiving the index finger and thumb of a user's hand 106.

The helical portion 112 is further described below in relation to FIG. 3.

Figure 2:
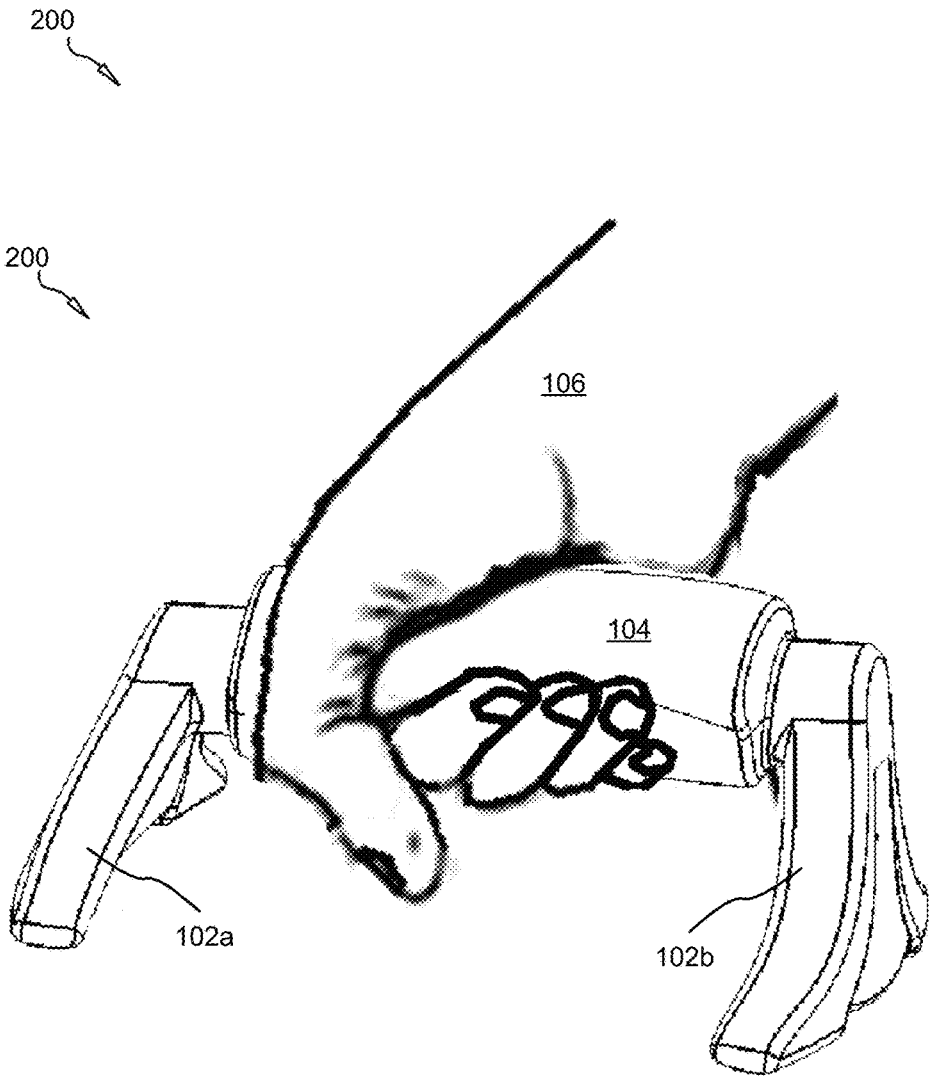
FIG. 2 is an environmental, side perspective view of an anatomical yoga handgrip and trainer for uniform distribution of weight in accordance with the present invention.

FIG. 2 is an environmental, side perspective view of an anatomical yoga handgrip and trainer 200 for uniform distribution of weight in accordance with the present invention.

As shown, the hand 106 grips the handgrip 104 with the thumb and index finger circumscribing the handgrip 104 in the recess 114. The hand 105 does not protrude upwardly in perpendicularity to the bar 126, rather the device 200 is adapted to orient such that the hand, wrist and arm just upwardly in inclination to the proximal end of the device 200.

Figure 3:
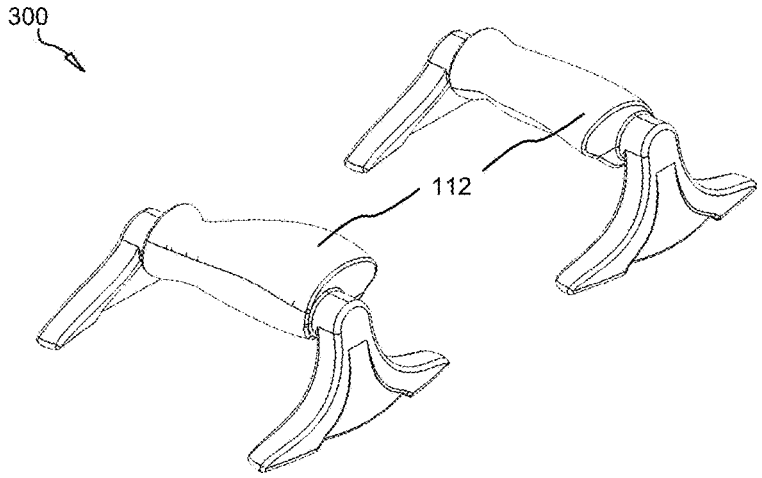
FIG. 3 is a side-rear perspective view of dual anatomical yoga handgrips and trainer for uniform distribution of weight in accordance with the present invention.

FIG. 3 is a side perspective view of dual anatomical yoga handgrips and trainer 300 for uniform distribution of weight in accordance with the present invention.

The handgrips 300 shown are mirror opposites of one another, each with an inwardly cantilevered helical portion 112 further described above and below in relation to other figures. The helical portion 112 may be arciform in shape. The helical portion 112 bulges outward laterally to help distribute pressure more evenly on the surface of a palm of a hand 105 engaging the bulbous helical portion 112 and relieve wrist strain. The helical portion 112 is bulbous and organically-shaped to contour the concave surfacing of a user's palm in a closed, or gripped, position. As such, the helical portion 112 bulges outward laterally and may bulge upward and downward in some embodiments. The helical portion 112 thickens toward the proximal ends 108 of the handgrips 300. The helical portion 112 may be sheered flat at the proximal ends 108 of the handgrips 300 as shown.

In various embodiments, the helical portion 112 bulging outwardly from the bar 126 is not parallel to the bar 126 but rather disposed at an angle thereto; and, in the shown embodiment, helical with respect to the bar 126 and the bar's 126 traversing axis. In this respect the helical portion 112, were it extending over a great distance, be spiral with respect to the bar 126.

The helical portion 112 may be domical or convex on its top surface in that the helical portion 112 may not be perfectly planar. The helical portion 112 comprises a wing which overhangs the remnant handgrip 104.

Figure 4:
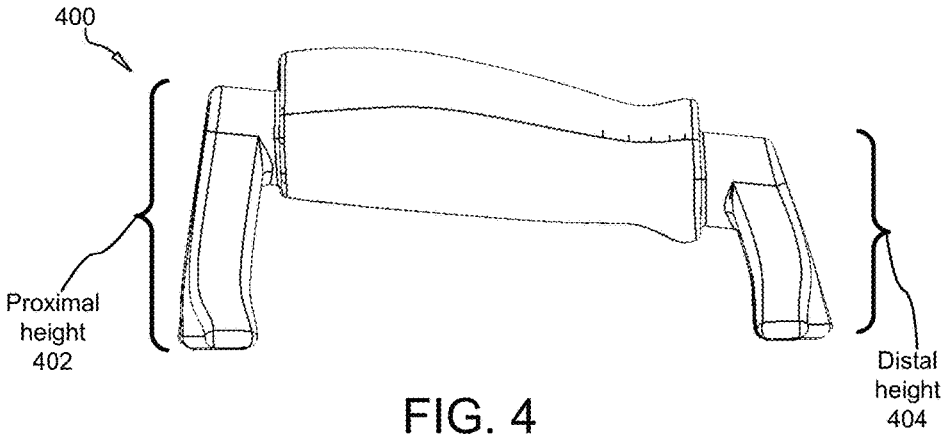
FIG. 4 is a side perspective view of an anatomical yoga handgrip and trainer for uniform distribution of weight in accordance with the present invention.

FIG. 4 is a side perspective view of an anatomical yoga handgrip and trainer 400 for uniform distribution of weight in accordance with the present invention.

As shown, the proximal height 402 is the height above a ground surface of the proximal end 108 of the device 400. The distal height 404 is the height above a ground surface of the distal end 100 of the device 400. The proximal height 402 exceeds the distal height 404 in the preferred embodiment.

Figure 5:
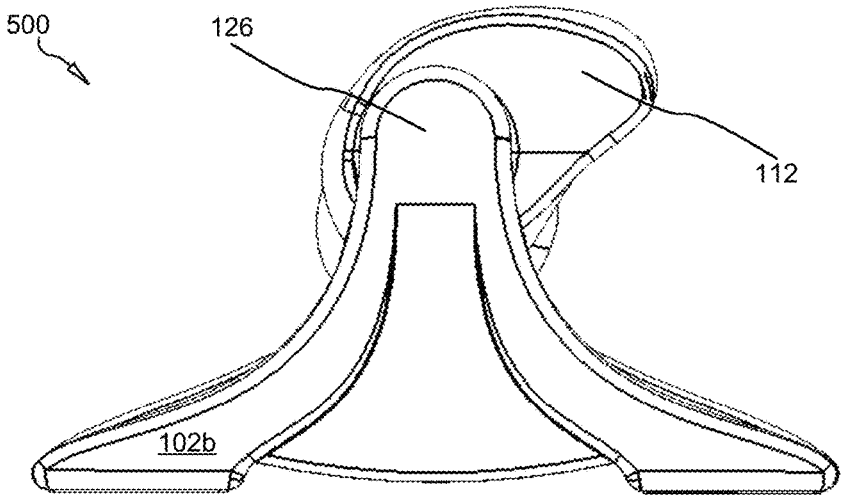
FIG. 5 is a rearward perspective view of an anatomical yoga handgrip and trainer for uniform distribution of weight in accordance with the present invention.

FIG. 5 is a rearward perspective view of an anatomical yoga handgrip and trainer 500 for uniform distribution of weight in accordance with the present invention.

The tapered upper portion of the proximal leg 102*b* is affixed to the bar 126.

Figure 6:
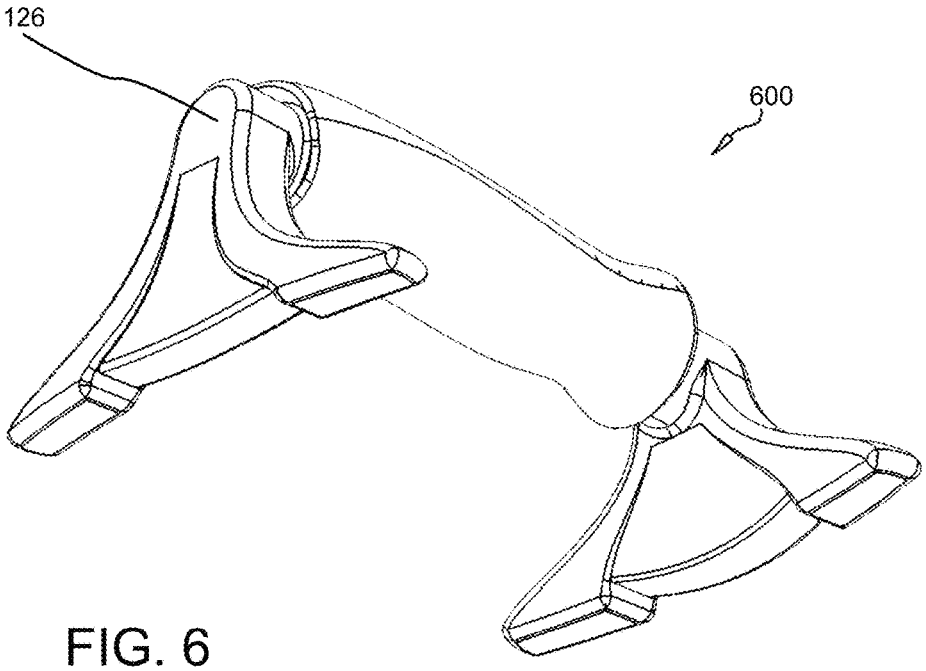
FIG. 6 is a lower perspective view of an anatomical yoga handgrip and trainer for uniform distribution of weight in accordance with the present invention.

FIG. 6 is a lower perspective view of an anatomical yoga handgrip and trainer 600 for uniform distribution of weight in accordance with the present invention.

As shown.

Figure 7:
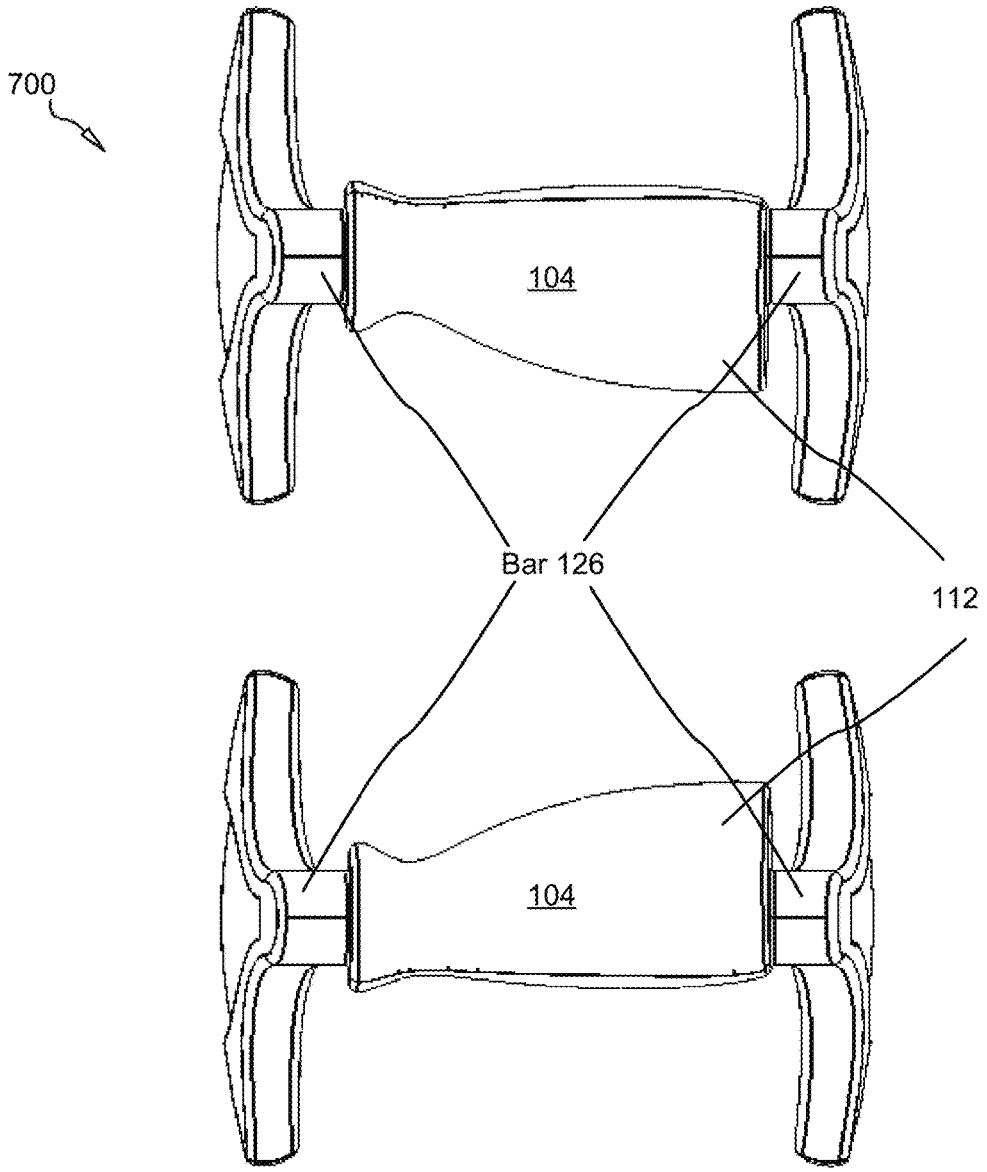
FIG. 7 is a top perspective view of dual anatomical yoga handgrips and trainer for uniform distribution of weight in accordance with the present invention.

FIG. 7 is a top perspective view of dual anatomical yoga handgrips and trainer 700 for uniform distribution of weight in accordance with the present invention.

The bar 126 traverses the devices 700 longitudinally within a recess formed by the handgrips 104. The helical portions 112 are laterally opposed, one for the left hand of a user and one for the right hand 106 of a user. The bar 126 may affix into recesses or cavities defined by the legs 102*a-b*.

Figure 8A:
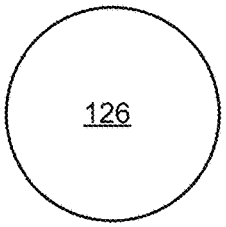
FIG. 8A is a cross-sectioned forward perspective view of a bar of an anatomical yoga handgrip for uniform distribution of weight in accordance with the present invention.

FIG. 8A is a cross-sectioned forward perspective view of a bar of an anatomical yoga handgrip for uniform distribution of weight in accordance with the present invention.

The bar 126 may have a circular cross-section as shown (and by cylindrical in three-dimensional space).

Figure 8B:
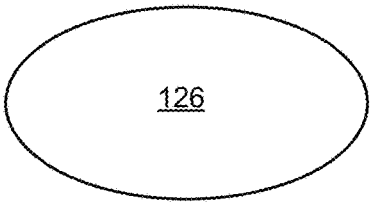
FIG. 8B is a cross-sectioned forward perspective view of a bar of an anatomical yoga handgrip for uniform distribution of weight in accordance with the present invention.

FIG. 8B is a cross-sectioned forward perspective view of a bar of an anatomical yoga handgrip for uniform distribution of weight in accordance with the present invention.

The bar 126 may have an oblong cross-section as shown. Alternatively, the bar 126 may be irregularly shaped through its cross section. The bar 126 may be formed from I-beams rods which are unconventionally-shaped, including arcuate bars 126 which curve upwardly through a midsection or toward the proximal end 108 of the device 500. In various embodiments, the arcuate bar 126 causes the bar 126 to decline toward the distal end 110 such that varying the relative heights of the leg 102*a* and leg 102*b* becomes unnecessary.

Figure 9:
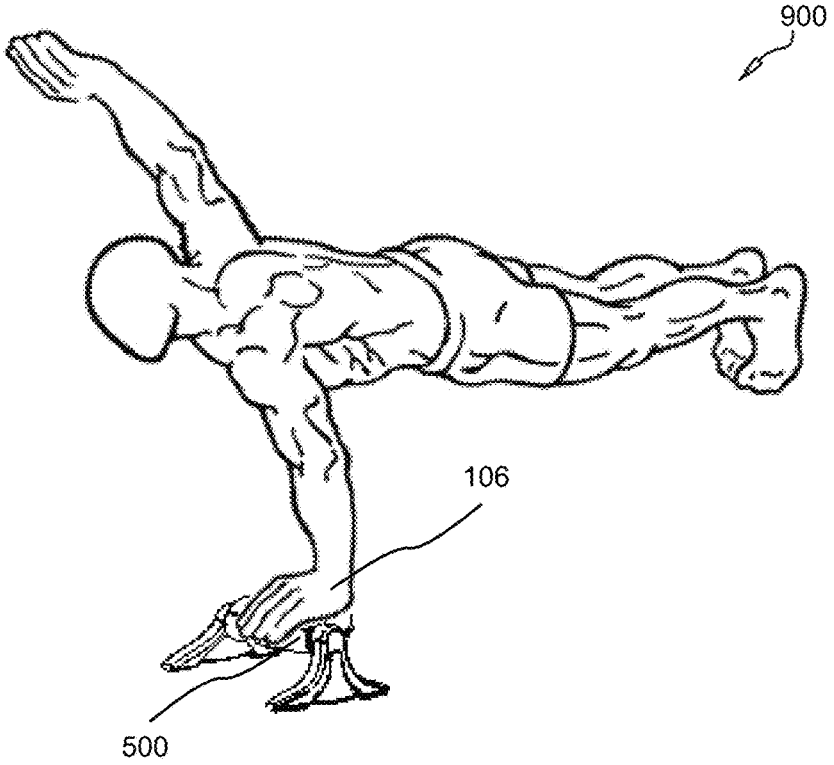
FIG. 9 is an environmental side perspective view of an anatomical yoga handgrip in use by a user in accordance with the present invention.

FIG. 9 is an environmental side perspective view of an anatomical yoga handgrip in use by a user in accordance with the present invention.

A user rests his hand 106 on the device 500, pressing all of the user's weight against one or two of the devices 500 resting on a ground surface. The user may perform a variety of exercises, poses or maneuvers as known to those of skill in the art.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A yoga training device for relieving wrist strain, the yoga training device comprising:

a distal leg for engaging a ground surface;

a proximal leg for engaging a ground surface; and an ergonomic handgrip extending between the distal leg and the proximal leg, the ergonomic handgrip having a distal end disposed a first height above a ground surface, a proximal end disposed a second height above the ground surface, a bulbous portion, and a narrow, annular distal neck recessed and configured to support the index finger and thumb of a user, wherein the bulbous portion extends generally horizontally and laterally to one lateral side of the yoga training device when the distal and proximal legs are positioned on a ground surface such that the bulbous portion is configured to support the palm of a user.

2. The yoga training device of claim 1, wherein the distal leg and the proximal leg are affixed to terminal ends of an axial bar.

3. The yoga training device of claim 1, wherein the distal leg and the proximal leg are integrally formed with an axial bar as a single integrated piece.

4. The yoga training device of claim 1, wherein the distal leg, the proximal leg and the handgrip are integrally formed with an axial bar as a single integrated piece.

5. The yoga training device of claim 3, wherein the single integrated piece comprises one of metal alloy or polymeric materials.

6. The yoga training device of claim 2, wherein the bar is cylindrical.

7. The yoga training device of claim 2, wherein the bar is oblong through a cross section.

8. The yoga training device of claim 1, wherein the second height of the proximal end exceeds the first height of the distal end by more than 10% such that the handgrip is declined toward the distal end.

9. The yoga training device of claim 1, wherein the bulbous portion cantilevers laterally from a proximal half of the handgrip forming a laterally overhanging wing.

10. The yoga training device of claim 1, wherein the distal neck is positioned on the distal end of the handgrip.

11. The yoga training device of claim 2, wherein the bar is arcuate.

12. The yoga training device of claim 1, wherein the distal leg and proximal leg are convex through an upwardly-rising plane.

13. The yoga training device of claim 1, wherein each of the distal leg and the proximal leg is v-shaped.

14. A yoga training device for relieving wrist strain, the yoga training device comprising:

an axial bar;

a distal leg for engaging a ground surface, the distal leg being affixed to the axial bar;

a proximal leg for engaging a ground surface, the proximal leg being affixed to the axial bar;

an ergonomic handgrip mounted on the axial bar and having a distal end, a proximal end, a cantilevered wing and a narrow, annular proximal neck recessed and configured to support the index finger and thumb of a user, wherein:

the distal end of the handgrip is disposed a first height above the ground surface;

the proximal end of the handgrip is disposed a second height above the ground surface, wherein the second height of the proximal end exceeds the first height of the distal end by 10-70% such that the handgrip is declined toward the distal end; and the cantilevered wing is configured to support the palm of a user.

15. The yoga training device of claim 14, wherein each of the distal leg and the proximal leg is v-shaped.

16. The yoga training device of claim 14, wherein the bar is oblong through a cross section.

17. The yoga training device of claim 14, wherein the handgrip is heat-pressed around the bar.

18. The yoga training device of claim 14, wherein the handgrip comprises leather.

19. A yoga training device for relieving torque on wrist, the yoga training device comprising:

a distal leg for engaging a ground surface;

a proximal leg for engaging a ground surface;

an ergonomic handgrip extending between the distal and proximal legs and having a distal end, a proximal end, a bulbous portion, and a narrow proximal neck recessed and configured to support the index finger and thumb of a user, wherein the bulbous portion is configured to support the palm of a user, wherein the bulbous portion cantilevers laterally from a proximal half of the handgrip, and wherein a distal neck is positioned on the distal end of the handgrip;

wherein the distal end of the handgrip is disposed a first height above the ground surface, wherein the proximal end of the handgrip is disposed a second height above the ground surface, and wherein the second height of the proximal end exceeds the first height of the distal end by 10-70% such that the handgrip is declined toward the distal end.

20. The yoga training device of claim 19, wherein each of the distal leg and the proximal leg is v-shaped.

* * * * *